US005611763A

United States Patent [19]

Lochbaum

[11] Patent Number: 5,611,763

[45] Date of Patent: Mar. 18, 1997

[54] STABILIZER FOR AQUATIC EXERCISE

[76] Inventor: Kenneth Lochbaum, 3002 E. 38th St., Erie, Pa. 16510-2924

[21] Appl. No.: 451,674

[22] Filed: May 26, 1995

Related U.S. Application Data

[63] Continuation-in-part of Ser. No. 365,498, Dec. 28, 1994.

[51] Int. Cl.[6] ..... A63B 21/008

[52] U.S. Cl. ..... 482/111; 482/55; 482/142

[58] Field of Search ..... 482/142, 111, 482/55, 904, 140, 139

[56] References Cited

U.S. PATENT DOCUMENTS

| | | | |
|---|---|---|---|
| 4,759,544 | 7/1988 | Diaz | 482/111 |
| 5,110,130 | 3/1992 | Shoebrooks | 482/140 |
| 5,234,391 | 8/1993 | Shasek et al. | 482/111 |
| 5,242,352 | 9/1993 | Elliot | 482/111 |
| 5,290,215 | 3/1994 | Lin | 482/140 |
| 5,417,636 | 5/1995 | Havens | 482/140 |
| 5,458,549 | 10/1995 | Obery | 482/140 |

*Primary Examiner*—Lynne A. Reichard
*Attorney, Agent, or Firm*—Lovercheck and Lovercheck

[57] ABSTRACT

The stabilizer devices for aquatic exercising and a device for aquatic exercise are disclosed. The stabilizers may be fixed to the side walls or bottom of a container of water to hold a person in an exercising position. The stabilizers may be portable or fixed permanently in position on a container of the water. The stabilizers may be rigid or flexible, may be completely immersed in water or completely above the water.

27 Claims, 4 Drawing Sheets

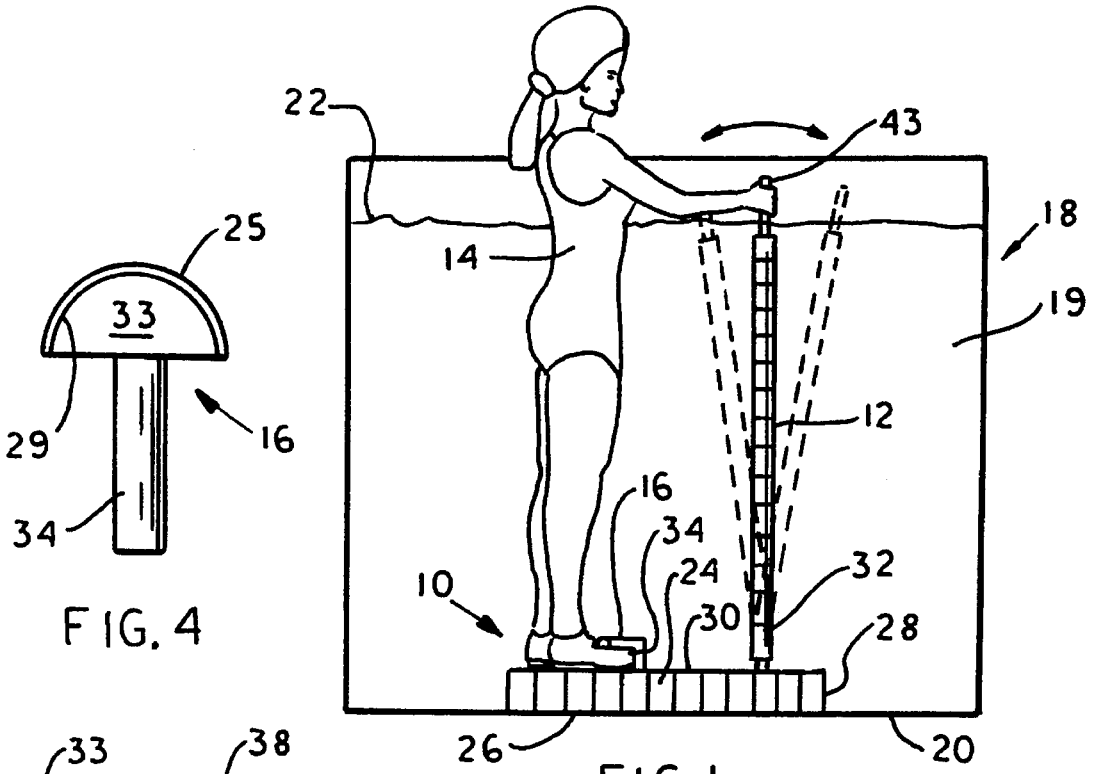
FIG. 1
FIG. 4
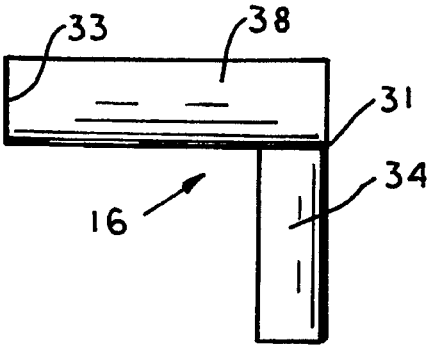
FIG. 3
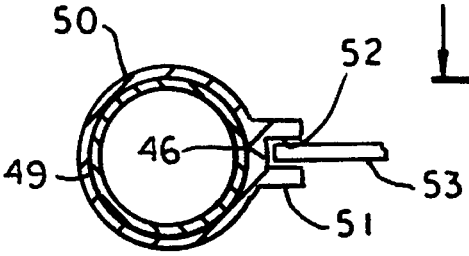
FIG. 2A
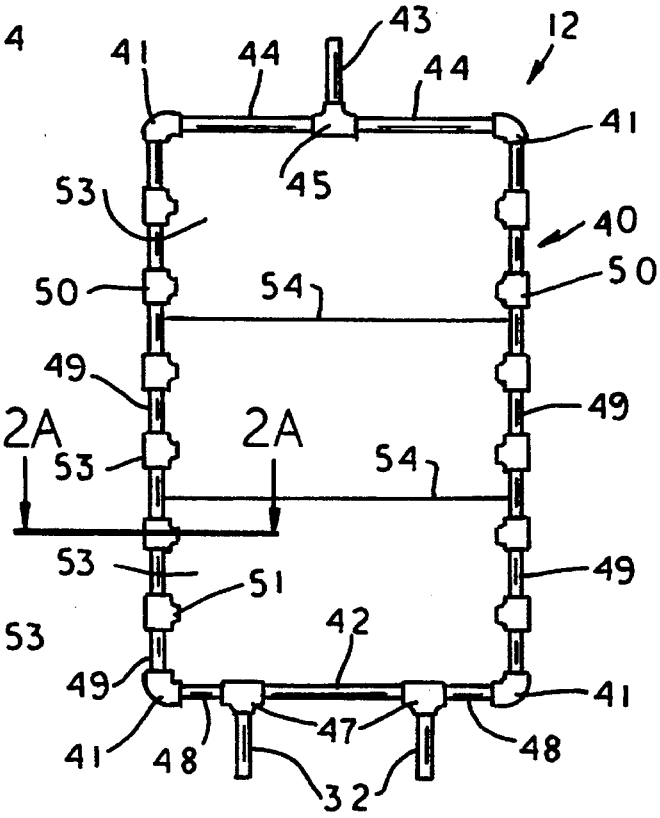
FIG. 2

STABILIZER FOR AQUATIC EXERCISE

BACKGROUND OF THE INVENTION

This application is a continuation-in-part application of copending Ser. No. 08/365,498 filed Dec. 28, 1994.

It is difficult for a person to maintain an exercise position in water during aquatic exercises without a stabilizer. According to the Archimedes Principle, a body immersed in water is buoyed up by a force equal to the weight of water displaced by the body. A human body will float when totally immersed in water and a very small force will move the body. Therefore, to hold themselves in place during aquatic exercise, persons must attach themselves to, hold onto, or otherwise engage a stabilizer. The stabilized person can then use their body and muscles much more efficiently and properly than when unstabilized. This greater efficiency allows the proper muscles to be strengthened. Stabilizers become more necessary the more completely the body is immersed in the water due to the buoyancy of the water.

Applicant's stabilizer can be cemented, bolted or otherwise permanently attached to the sides or bottom of a pool. Applicant's stabilizer can also be made portable, for example, by means of suction cups or other removably attaching means, which may be affixed to the pool wall or bottom, and hold the stabilizer in position. This position can then be changed, adjusted or moved, the stabilizer could even be taken to another body of water. The stabilizer can also be temporarily attached to the attaching base disclosed in co-pending application Ser. No. 08/365,498. This structure permits quick adjustments in the position of the stabilizers to accommodate different position needs for different exercises. The design of the stabilizers can be any shape or form depending on the stabilizer's purpose, or the particular muscle to be strengthened or stretched.

Applicant's drawings show examples of stabilizing devices which can be permanent, portable or temporary, according to the way they are attached to the side or bottom of the pool.

Applicant is aware of the following U.S. Patents: U.S. Pat. No. 2,875,528 to Garate; U.S. Pat. No. 3,415,475 to Goodman; U.S. Pat. No. 3,861,675 to Hopper; U.S. Pat. No. 4,145,044 to Wilson; U.S. Pat. No. 4,170,799 to Ratelband; U.S. Pat. No. 4,247,096 to Schmitt; U.S. Pat. No. 4,759,544 to Diaz; U.S. Pat. No. 4,784,385 to D'Angelo; U.S. Pat. No. 5,219,317 to Beasley; U.S. Pat. No. 5,242,352 to Elliott; and, U.S. Pat. No. 5,372,564 to Spirito.

SUMMARY OF THE INVENTION

Applicant has provided several examples of stabilizers which may be used by an exerciser to support themselves in water in an exercise position relative to a resistance element exercise device. Without the stabilizer when an exerciser pulls or pushes a resistive element through the water, the resistance to the movement imposes a substantially equal force opposite in direction upon the exerciser. Due to the buoyancy of the water, the exerciser cannot maintain an exercise position without a stabilizer. In swinging a paddle type resistance element through the water for example, the unrestrained exerciser will be lifted right off of his feet and turned in counter rotation to the direction of the swing. The stabilizers may be secured to a base and provide a structure to engage the exerciser. A structure may be provided to engage the foot of the exerciser or may be provided to engage other parts of the body of the exerciser in a standing, sitting or other position. Flexible straps may be provided to secure the exerciser to the stabilizer.

It is an object of the present invention to provide a stabilizer for aquatic exercise that is simple in construction, economical to manufacture and simple and efficient to use.

It is another object of the present invention to provide a stabilizer that can be fixed in position in a body of water and the body of a person can engage the stabilizer to hold the body in exercise position in the water.

It is another object of the present invention to provide a stabilizer which is portable.

It is another object of the present invention to provide a stabilizer that can be used in any depth of water or while the person exercising is fully immersed in the water.

With the above and other objects in view, the present invention consists of the combination and arrangement of parts hereinafter more fully described, illustrated in the accompanying drawing and more particularly pointed out in the appended claims, it understood that changes may be made in the form, size, proportions and minor details of construction without departing from the spirit or sacrificing any of the advantages of the invention.

BRIEF DESCRIPTION OF THE DRAWING(S)

FIG. 1 is a side view of a container of water with one side wall of the container removed showing an exercising device supported on a base and a foot stabilizer according to the invention.

FIG. 2 is a front view of the exercising device shown in FIG. 1.

FIG. 2A is an enlarged cross sectional view of the exercising device taken at line 2A—2A of FIG. 2.

FIG. 3 is an enlarged side view of the foot stabilizer shown in FIG. 1.

FIG. 4 is an enlarged end view of the foot stabilizer shown in FIGS. 1 and 3.

DESCRIPTION OF THE PREFERRED EMBODIMENT(S)

Figure 5:
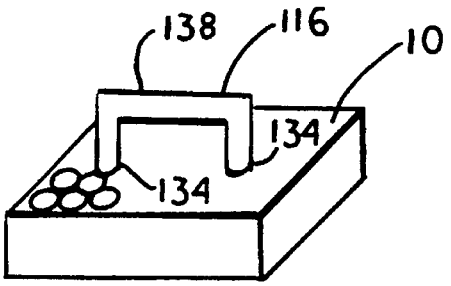
FIG. 5 is an isometric view of a foot stabilizer having two posts attached to a base.

Now with more particular reference to the drawings, FIG. 1 shows base member 10 supporting exercise device 12. Person 14 is supported in an exercise position on base member 10 by aquatic foot stabilizer device 16. Without the stabilizer when an exerciser pulls or pushes a resistive element through the water, the resistance to the movement imposes a substantially equal force opposite in direction upon the exerciser. Due to the buoyancy of the water, the exerciser cannot maintain an exercise position without a stabilizer. In swinging a paddle type resistance element through the water for example, the unrestrained exerciser will be lifted right off of his feet and turned in counter rotation to the direction of the swing. In the example shown in FIG. 1, exercise device 12 may be made of plastic plumbing fittings of a type familiar to those skilled in the art.

Without foot stabilizer device 16, person 14 would not be able to maintain a stationary exercising position due to the buoyancy of water 19. Container 18 of water 19 could be a pool, exercise tank, pond, lake or river for example. Water 19 has top surface 22 and a depth between bottom 20 and top surface 22 sufficient to provide an aquatic exercise environment.

Base member 10 may cover the entire bottom 20 or a part thereof. Base member 10 may be permanently attached or removably attached to bottom 20. Base member 10 may be made of short pieces of plastic pipe 24 set on end and attached together by suitable adhesive to form a flat top surface with continuous equally spaced openings 30 disposed in rows and columns to receive posts 32 for stabilizing on exercise device 12. Openings 30 in top 24 also provide a wide range of positions for exercise device 12 and for foot stabilizer device 16.

Posts 32 may be the same shape as openings 30, or may be non-circular in cross section, that is, square, hexagonal, octagonal, or oval to provide a better holding force with the side walls of openings 30.

Aquatic exercise device 12 shown in FIGS. 1, 2 and 2A has rectangular frame 40 with corners made of plumbing elbows 41 connected to plastic plumbing pipe 44,49. Handle 43 is held in place by T-fitting 45 that is connected to pipes 44. T-fitting 50 have outwardly extending flanges 51 which have slots 52 therein. Slots 52 receive edges 46 of panels 53. Panels 53 overlap at 54 so that they can be slid into and out of overlying positions thereby increasing or decreasing the resistance of water 19 in exercising device 12 as it is swung in water 19 by person 14. Posts 32 are received in T-fittings 47 and in apertures 30 in base 10. T-fittings 47 are connected together by pipe 42. Pipes 48 are rotatably received in T-fittings 47 so that posts 32, T-fittings 47 and pipe 42 can rotate relative to pipe 48.

Aquatic foot stabilizer device 16, shown in FIGS. 1, 3 and 4 has support bar 38 attached to post 34 at end 31. Post 34 is received in one of openings 30 in base member 10. Person 14 can insert the front part of her foot into open end 33 of stabilizer device 16 to hold her foot and her body in position.

FIG. 5 shows another embodiment of foot stabilizer 116 having foot support bar 138 attached at its ends to posts 134. Posts 134 are received in openings 30 of base 10 and provide a space for an exercising person's foot between foot support bar 138 and base 10.

Figure 6:
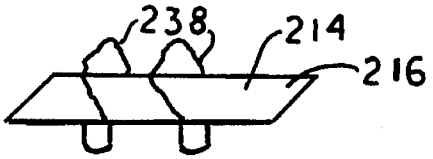
FIG. 6 is an isometric view of a foot stabilizer having a plate, foot straps and two posts to engage a base.
Figure 7:
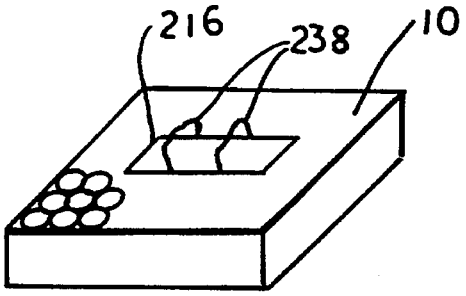
FIG. 7 is an isometric view of the stabilizer shown in FIG. 6 supported on a base.

FIGS. 6 and 7 shows another embodiment of stabilizing device 216 having posts 215 fixed to plate member 214 to be received in openings 30 in base member 10. Flexible stabilizer members 238 have ends fixed to plate member 214 providing a space between flexible members 238 and plate member 214 to receive a foot of an exercising person. A stabilizing device incorporating more than two posts could also be used.

Figure 8:
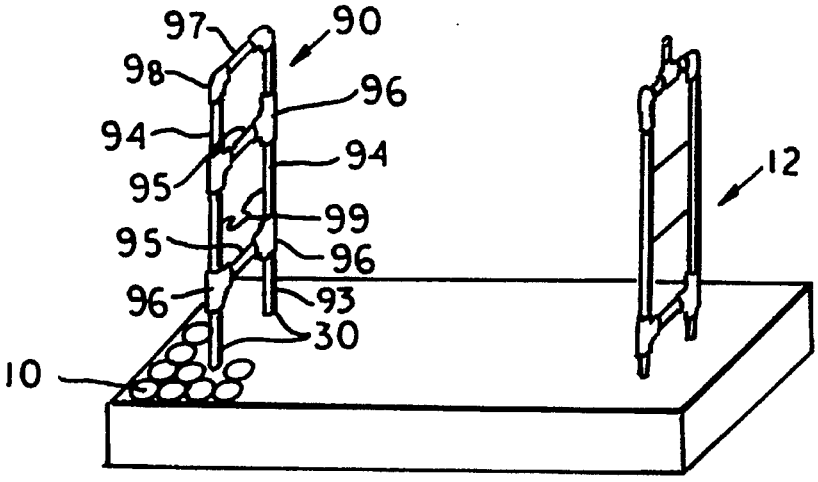
FIG. 8 is an isometric view of an upright stabilizer with a belt for engaging the body of a person and an exercise device on the base.

FIG. 8 shows stabilizer 90 and exercising device 12. Stabilizer 90 has upright members 94 having lower ends 93 received in holes 30 in base member 10. Flexible belt 99 is attached to upright members 94. Upright members 94 and transverse member 95 are held together by plastic plumbing T-fittings 96. Transverse member 97 is attached to elbows 98.

Figure 9:
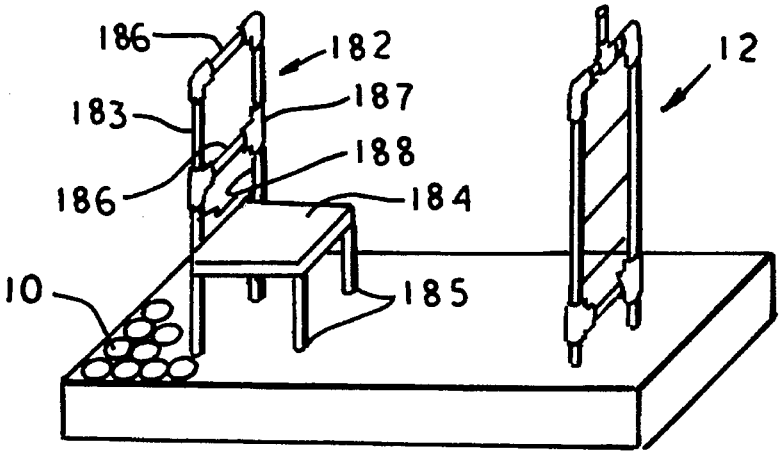
FIG. 9 is an isometric view of a base having a chair stabilizer and an exercise device.

FIG. 9 shows exercise device 12 like shown in FIG. 9 and chair 182. Chair 182 has upright members 183, seat 184 and legs 185. Legs 185 are attached to the corners of seat 184. Upright members 183 are rigidly supported generally parallel to each other by cross members 186 and T-fittings 187. Lower ends of upright members 183 and legs 185 are received in openings 30 in base 10. One or more belts 188 may be provided to secure person 14 in a desired exercise position on chair 182.

Figure 10:
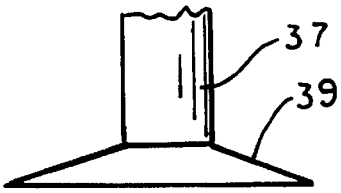
FIG. 10 is a single upright member supported on a vacuum cup.

FIG. 10 shows a single stabilizer bar 37 attached to vacuum cup 39. Vacuum cup 39 may be made of rubber or other suitable flexible resilient material. Vacuum cup 39 could be attached to any smooth flat surface, like a swimming pool bottom or side. Vacuum cups 39 may be attached to any upright bar 36 of a stabilizer to provide a means to fix the stabilizing member in an exercise position.

Figure 10A:
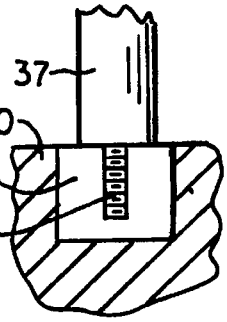
FIG. 10A is a simple upright member fixed to the bottom of a pool.

FIG. 10A shows single stabilizer bar 37 having a securing means such as threaded member 27 fixed to and extending downwardly from its lower end. Securing means may be attached to any upright bar 36 of a stabilizer. Socket member 26 may be secured in pool bottom 20. Threaded member 27 may be received in socket member 26 to secure any stabilizing member in an exercise position.

Figure 11:
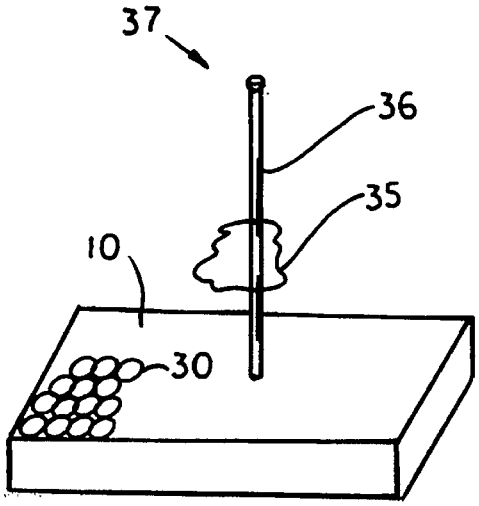
FIG. 11 is an isometric view of a single upright stabilizer on a base and a belt.

FIG. 11 shows another embodiment of the stabilizer having upright bar 36 received in opening 30 in base member 10 and flexible stabilizing member 35 is attached to bar 36. Base member 10 is made like FIG. 1.

Figure 12:
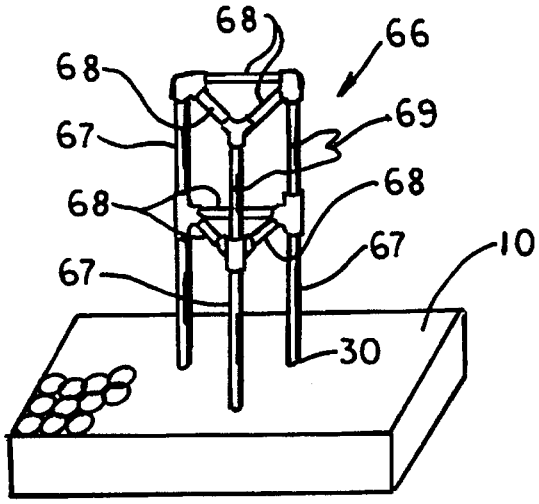
FIG. 12 is an isometric view of a base and a stabilizer having three upright members.

FIG. 12 shows stabilizer 66 which may be made up of three upright members 67 which are rigidly held together generally parallel to each other by cross members 68. The lower ends of upright members 67 are received in openings 30 in base 10. One or more restraining means or belt 69 may be provided to secure person 14 to stabilizer 66 to maintain person 14 in a desired exercise position relative to stabilizers or other devices.

Figure 13:
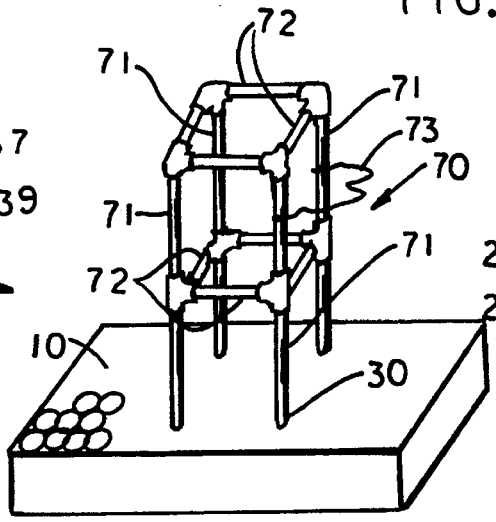
FIG. 13 is a stabilizer with a base and four upright members and a flexible belt.

FIG. 13 shows another embodiment of stabilizer 70 which is like stabilizer 66 in FIG. 12, but with four upright members 71, cross members 72 and belt 73

Figure 14:
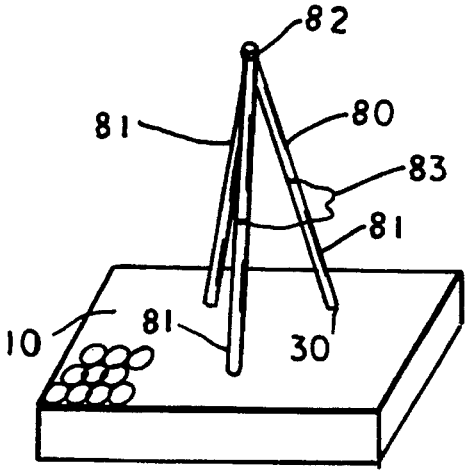
FIG. 14 is an isometric view of a base and three inclined members.

FIG. 14 shows stabilizer 80 having inclined members 81 connected at upper end 82 with lower ends received in openings 30 in base 10 and restraint 83.

Figure 15:
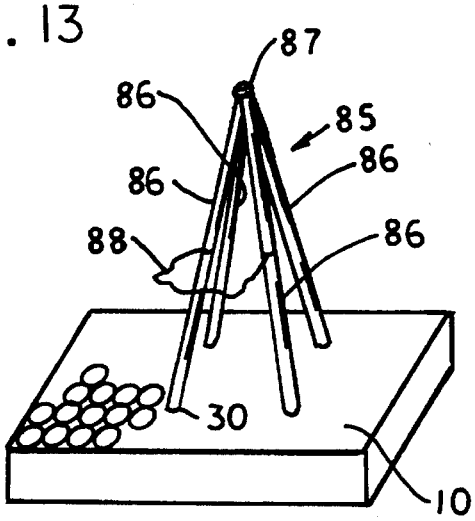
FIG. 15 is an isometric view of a stabilizer with a base and four inclined members.

FIG. 15 shows stabilizer 85 and four inclined members 86 supported in openings 30 on base member 10 and joined together by top member 87. The lower ends of inclined member 86 are inserted into openings 30 in base 10. Belt restraint 88 is attached to upright member 86.

Figure 16:
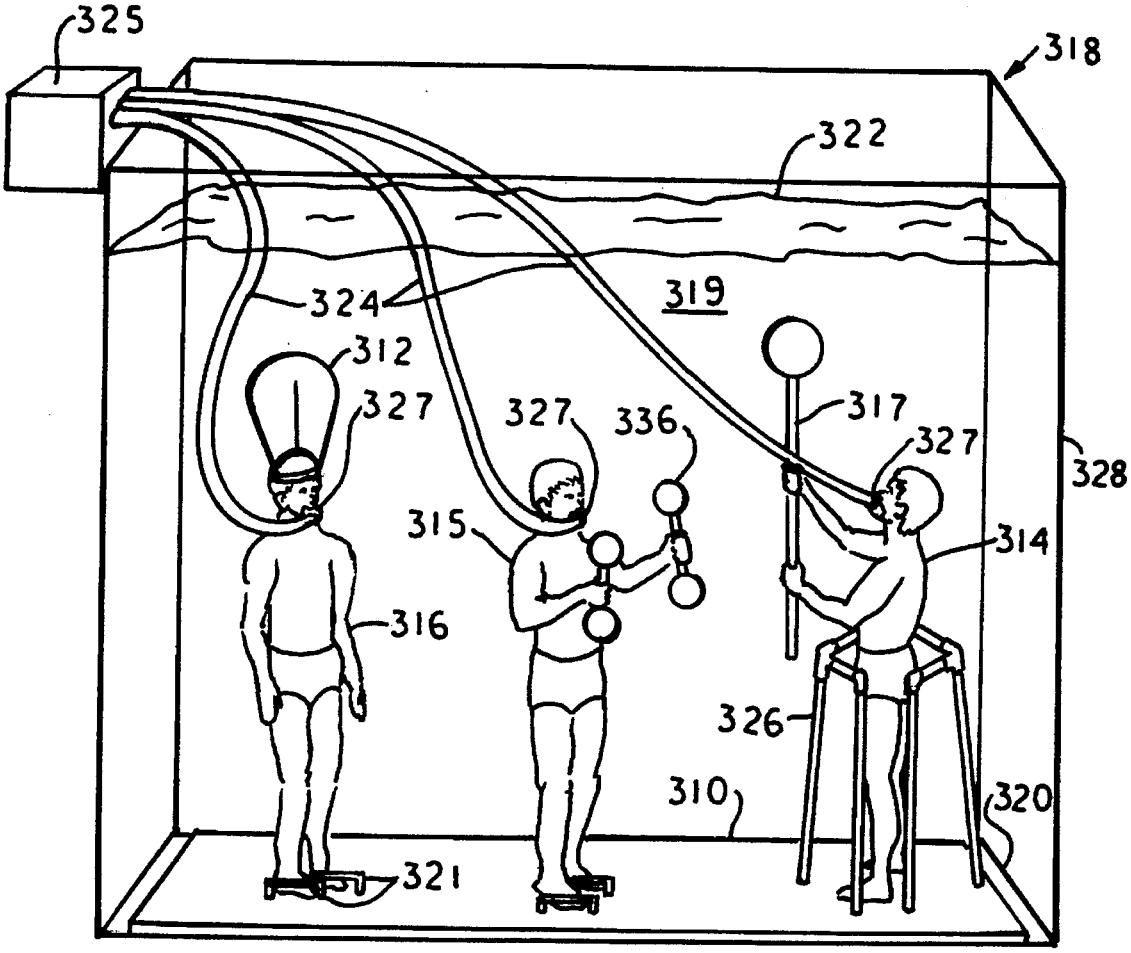
FIG. 16 is a side view of a deep pool showing air being supplied to persons exercising who are secured in an exercise position with stabilizers that are using various water resistance exercise devices.

FIG. 16 shows a deep water exercise pool where persons exercising 314,315,316 are completely immersed in water 319. Pool or container of water 318 has pool sides 328. Water 319 is sufficiently deep from bottom 320 to top surface 322 so that the person exercising may use a water resistant device such as golf club 317 above his head without the water resistance device leaving or partially leaving water 319. Therefore, the resistance function of the device is maintained throughout the exercise. Base 310 may be placed on bottom 320 on which foot stabilizers 321 may be fixed to bottom 320 or releasably secured to base 310 to support persons exercising 314,315,316 in exercise positions. Air supply lines 324 supply air to persons exercising 314,315, 316 from air supply means 325. Air is breathed by persons exercising 314,315,316 through air regulator 327. Torso engaging stabilizer means 326 comprises upright members which partially surround person exercising 314 to secure him in an exercise position. The person may be secured to or engaged by the stabilizer means.

Exercise person 314 is exercising with water resistance golf club 317 or other water resistant handled sports implement such as a tennis racquet, bat and so on. Exercise person 315 is exercising with hand held water resistant devices which are useful for simulated exercises. Exercise person 316 has neck exercising device 312 comprising water resistant member upwardly extending from head engaging attachment which secures device to the head of exercise person 316 whereby the neck may be exercised by movement of resistance member through water 319.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A stabilizing device for use when engaged in water resistive element aquatic exercise in a container of water having bottom and side walls;

attaching means attaching said stabilizing device to said container;

a foot engaging means on said stabilizing device for engaging the top of a foot of a person while leaving the hands and arms free during aquatic exercise in said water whereby the person is supported in an exercise position.

2. The device recited in claim 1 wherein said attaching means comprises a base, a top surface on said base having at least one aperture extending into said base;

said stabilizing device comprising a stabilizing portion and a post portion;

said aperture receiving and releasably securing said post portion whereby said stabilizing device is releasably secured to said base.

3. The stabilizing device recited in claim 1 wherein said base is made of short pieces of pipe with open upward ends and attached together to form a support surface with openings for receiving posts of stabilizing equipment.

4. The aquatic stabilizing device recited in claim 2 wherein said top surface of said base provides a surface for an exercising person to stand on.

5. The aquatic stabilizer device recited in claim 2 wherein said post portion is a downwardly extending part of said stabilizer device and said stabilizing portion is a rearwardly extending foot bar that is attached to said post providing a space below said foot bar for a foot of said person.

6. The aquatic stabilizer device recited in claim 5 wherein said foot bar has a downwardly open half cylinder surface.

7. The aquatic stabilizer device recited in claim 2 wherein an array of said apertures are formed in said top surface of said base; and, said apertures are disposed closely adjacent to one another and are generally disposed in rows and columns.

8. The aquatic stabilizer device recited in claim 2 wherein said aperture is circular.

9. The aquatic stabilizer device recited in claim 2 wherein said apertures are square in cross section.

10. The aquatic stabilizer device recited in claim 6 wherein said stabilizing device comprises an elongated flexible member.

11. The aquatic stabilizer device recited in claim 5 wherein said apertures are hexagonal in shape and form apertures that are equally spaced along three diagonals to receive said support members.

12. A stabilizing device for use with resistive element aquatic exercise equipment comprising a base adapted to rest on the bottom of a body of water;

said base having an aperture;

a support member having a first end received in said aperture;

said support member having a second end spaced from said aperture;

body engaging means fixed to said second end of said support member for engaging the body of an exercising person while leaving the hands and arms free.

13. The device recited in claim 12 wherein said support member comprises a post.

14. The device recited in claim 12 wherein said support member is made of pipe made of thermoplastic material.

15. The device recited in claim 14 wherein said device has two posts held together by thermoplastic plumbing pipe and plumbing fittings.

16. The device recited in claim 14 wherein said device has three posts held together by plastic fittings.

17. The device recited in claim 14 wherein said device has four posts held together by thermoplastic T's and elbows attached to said pipe.

18. The aquatic stabilizer device recited in claim 1 wherein said stabilizer is attached to said container by a vacuum cup.

19. The aquatic stabilizer device recited in claim 1 wherein said stabilizer is attached to said container by means of a body of heavier than water material.

20. An aquatic exercising device;

said device comprising a container having a bottom;

water in said container;

said water having a top surface above said bottom a distance of more than 8 feet;

a stabilizer supported on said bottom adapted to engage the body of the person using said device while leaving the hands and arms free whereby the person's body is held in exercise position in said water.

21. The exercising device recited in claim 20 wherein stabilizer has a body engaging member thereon; and, body engaging member adapted to engage torso of the person whereby the person's body is retained in position against movement during aquatic exercise.

22. The exercising device recited in claim 21 wherein said body engaging member is attached to said bottom and having an upper end with said body engaging means adapted to engage the torso of the person whereby the person's body is retained in position during aquatic exercise.

23. The exercising device recited in claim 20 wherein air supply is provided for said person;

said air supply including a head set for converting said air.

24. The exercising device recited in claim 20 wherein an exercise device includes a helmet and a resistance element on said helmet for neck exercise.

25. The exercising device recited in claim 20 wherein said devices includes a golf club.

26. A stabilizer to secure an exerciser in an exercise position for resistive element aquatic exercise in a container having a bottom;

water in said container;

said stabilizer supported on said bottom adapted to engage the top of the foot of an exercising person while leaving the hands and arms free whereby the person's top of the foot is held in exercise position in said water.

27. A stabilizing device for aquatic exercise in a container of water having bottom and side walls;

attaching means attaching said stabilizing device to said container;

a body engaging means on said stabilizing device for engaging the body of a person during aquatic exercise in said water whereby the person is supported in an exercise position;

said attaching means comprises a base, a top surface on said base having at least one aperture extending into said base;

said stabilizing device comprising a stabilizing portion and a post portion;

said aperture receiving and releasably securing said post portion whereby said stabilizing device is releasably secured to said base;

said post portion is a downwardly extending part of said stabilizing device and said stabilizing portion is a rearwardly extending foot bar that is attached to said post providing a space below said foot bar for a foot of said person.

* * * * *